US011773614B2

(12) United States Patent
Huang et al.

(10) Patent No.: US 11,773,614 B2
(45) Date of Patent: Oct. 3, 2023

(54) POOL CLEANER WITH RELEASABLE BRUSH ASSEMBLY

(71) Applicant: INTEX INDUSTRIES XIAMEN CO. LTD., Fujian (CN)

(72) Inventors: Zhi Xiong Huang, Fujian (CN); Wen Xiao Zhang, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 17/612,474

(22) PCT Filed: May 21, 2020

(86) PCT No.: PCT/IB2020/054860

§ 371 (c)(1),
(2) Date: Nov. 18, 2021

(87) PCT Pub. No.: WO2020/234835

PCT Pub. Date: Nov. 26, 2020

(65) Prior Publication Data

US 2022/0235571 A1 Jul. 28, 2022

(30) Foreign Application Priority Data

May 21, 2019 (CN) ..... 201920735173.6

(51) Int. Cl.
*E04H 4/16* (2006.01)
*A46B 13/00* (2006.01)

(52) U.S. Cl.
CPC ..... *E04H 4/1654* (2013.01); *A46B 13/001* (2013.01); *E04H 4/16* (2013.01); *E04H 4/1636* (2013.01); *A46B 2200/30* (2013.01)

(58) Field of Classification Search
CPC ..... E04H 4/16; E04H 4/1654; E04H 4/1636; A46B 13/001
See application file for complete search history.

(56) References Cited

U.S. PATENT DOCUMENTS 3,430,277 A 3/1969 Ortega
3,822,754 A 7/1974 Henkin
(Continued)

FOREIGN PATENT DOCUMENTS

CA 3031667 2/2018
CN 103835536 A 6/2014
(Continued)

OTHER PUBLICATIONS

National Intellectual Property Administration, PRC, International Search Report and Written Opinion for International Application No. PCT/IB2020/054860, dated Jul. 29, 2020.
(Continued)

*Primary Examiner* — Michael D Jennings
(74) *Attorney, Agent, or Firm* — Faegre Drinker Biddle & Reath LLP

(57) ABSTRACT

A pool cleaner equipped with a rotating brush assembly is disclosed. The brush assembly is removably coupled to the pool cleaner using clamps that are readily accessible, supported by the pool cleaner, and operable by hand. The clamps may be manipulated between a ready configuration, a loaded configuration to receive a brush assembly, and a locked configuration to secure the brush assembly.

16 Claims, 12 Drawing Sheets

(56) References Cited

U.S. PATENT DOCUMENTS

| | | | |
|---|---|---|---|
| 3,950,809 | A | 4/1976 | Schatzmann |
| 4,962,559 | A | 10/1990 | Schuman |
| 5,001,800 | A | 3/1991 | Parenti |
| 5,245,723 | A | 9/1993 | Sommer |
| 5,317,776 | A | 6/1994 | DeMoura |
| 5,351,355 | A | 10/1994 | Chiniara |
| 5,454,129 | A | 10/1995 | Kell |
| 5,507,058 | A | 4/1996 | Minami |
| 5,569,371 | A | 10/1996 | Perling |
| 5,768,734 | A | 6/1998 | Dietrich |
| 5,896,610 | A | 4/1999 | Sebor |
| 6,099,658 | A | 8/2000 | Porat |
| 6,155,657 | A | 12/2000 | Erlich |
| 6,212,725 | B1 | 4/2001 | Porat |
| 6,248,232 | B1 | 6/2001 | Stoner |
| 6,299,699 | B1 | 10/2001 | Porat |
| 6,448,494 | B1 | 9/2002 | Erlich |
| 6,564,417 | B2 | 5/2003 | Porat |
| 6,742,613 | B2 | 6/2004 | Erlich |
| 6,797,157 | B2 | 9/2004 | Erlich |
| 6,939,460 | B2 | 9/2005 | Erlich |
| 6,954,960 | B2 | 10/2005 | Pichon |
| 6,971,136 | B2 | 12/2005 | Horvath |
| 7,060,182 | B2 | 6/2006 | Erlich |
| 7,117,554 | B2 | 10/2006 | Pichon |
| 7,178,188 | B1 | 2/2007 | Jaakola |
| 7,328,473 | B2 | 2/2008 | Deklinski |
| 7,437,790 | B1 | 10/2008 | Ajello |
| 7,520,015 | B1 | 4/2009 | Ajello |
| 7,636,975 | B2 | 12/2009 | Mah |
| 7,849,547 | B2 | 12/2010 | Erlich |
| 8,128,815 | B1 | 3/2012 | Simmons |
| 8,141,191 | B2 | 3/2012 | Hui |
| 8,225,446 | B2 | 7/2012 | Hui |
| 8,261,759 | B2 | 9/2012 | Kelle |
| 8,281,441 | B1 | 10/2012 | Erlich |
| 8,296,891 | B1 | 10/2012 | Rowam |
| 8,307,485 | B2 | 11/2012 | Sumonthee |
| 8,341,789 | B2 | 1/2013 | Garti |
| 8,424,142 | B2 | 4/2013 | Garti |
| 8,434,182 | B2 | 5/2013 | Horvath |
| 8,505,143 | B2 | 8/2013 | Finezilber |
| 8,623,201 | B2 | 1/2014 | Hui |
| 8,661,594 | B2 | 3/2014 | Hui |
| 8,800,088 | B2 | 8/2014 | Garti |
| 8,869,337 | B2 | 10/2014 | Sumonthee |
| 9,021,645 | B2 | 5/2015 | Garti |
| 9,119,463 | B2 | 9/2015 | Gopalan |
| 9,677,294 | B2 | 6/2017 | Renaud |
| 10,494,829 | B2 | 12/2019 | Lavabre |
| 2003/0101523 | A1 | 6/2003 | Lepley, Jr. |
| 2004/0168838 | A1 | 9/2004 | Erlich |
| 2005/0108836 | A1 | 5/2005 | Rowan |
| 2005/0247613 | A1 | 11/2005 | Bishop |
| 2006/0048312 | A1 | 3/2006 | Horvath |
| 2006/0059637 | A1 | 3/2006 | Fridman |
| 2006/0064825 | A1 | 3/2006 | Reed |
| 2006/0265820 | A1 | 11/2006 | Erlich |
| 2007/0107148 | A1 | 5/2007 | Rowan |
| 2008/0141471 | A1 | 6/2008 | Supra |
| 2008/0169247 | A1 | 7/2008 | Peterson |
| 2008/0244842 | A1 | 10/2008 | Lavabre |
| 2011/0000030 | A1 | 1/2011 | Pichon |
| 2012/0102665 | A1 | 5/2012 | Hui |
| 2014/0137343 | A1 | 5/2014 | Correa |
| 2014/0259464 | A1 | 9/2014 | Renaud |
| 2014/0273541 | A1 | 9/2014 | Renaud |
| 2015/0101135 | A1 | 4/2015 | Witelson |
| 2015/0121636 | A1 | 5/2015 | Hui |
| 2015/0267431 | A1 | 9/2015 | Garti |
| 2016/0145884 | A1* | 5/2016 | Erlich ..... E04H 4/1654 15/1.7 |
| 2016/0215516 | A1* | 7/2016 | Hayes ..... B04C 5/26 |
| 2018/0127999 | A1 | 5/2018 | Durvasula |
| 2018/0163422 | A1* | 6/2018 | Klebanov ..... C02F 1/001 |
| 2018/0172114 | A1* | 6/2018 | Stoltz ..... F16H 3/34 |
| 2018/0328059 | A1* | 11/2018 | Hayes ..... E04H 4/1654 |
| 2019/0058286 | A1 | 2/2019 | Shimeno |
| 2019/0203490 | A1* | 7/2019 | Borg ..... E04H 4/1672 |
| 2020/0150679 | A1 | 5/2020 | Yu |
| 2020/0256076 | A1 | 8/2020 | van der Meijden |
| 2021/0131805 | A1 | 5/2021 | Biber |

FOREIGN PATENT DOCUMENTS

| | | | |
|---|---|---|---|
| CN | 103867000 | A | 6/2014 |
| CN | 205065124 | | 3/2016 |
| CN | 207277924 | | 4/2018 |
| CN | 207526181 | | 6/2018 |
| CN | 208152635 | U | 11/2018 |
| CN | 208380174 | U | 1/2019 |
| CN | 109723251 | | 5/2019 |
| CN | 210106835 | | 2/2020 |
| CN | 210239260 | | 4/2020 |
| CN | 210239261 | U | 4/2020 |
| FR | 2735437 | | 12/1996 |
| GB | 2015331 | | 9/1979 |
| RU | 97156 | | 8/2010 |
| WO | 2004/097145 | | 11/2004 |
| WO | WO-2019058286 | A1 * | 3/2019 ..... E04H 4/1654 |

OTHER PUBLICATIONS

International Preliminary Report on Patentability, issued by the International Searching Authority, dated Nov. 16, 2021, for International Patent Application No. PCT/IB2020/054860; 6 pages.

International Search Report and Written Opinion, issued by the International Searching Authority, dated Sep. 3, 2020, for International Patent Application No. PCT/IB2020/054855; 10 pages.

International Preliminary Report on Patentability, issued by the International Searching Authority, dated Nov. 16, 2021, for International Patent Application No. PCT/IB2020/054855; 6 pages.

Search Report issued by the Federal Service on Intellectual Property (FIPS), dated Jun. 29, 2023, for Russian Patent Application No. 2021133582; 2 pages.

English translation of the Search Report issued by the Federal Service on Intellectual Property (FIPS), dated Jun. 29, 2023, for Russian Patent Application No. 2021133582; 2 pages.

* cited by examiner

POOL CLEANER WITH RELEASABLE BRUSH ASSEMBLY

CROSS REFERENCE TO RELATED APPLICATION

This application is a national stage application of Internation Application No. PCT/IB2020/054860 filed May 21, 2020, which claims priority to Chinese Application Serial No. 201920735173.6 filed May 21, 2019, the disclosures of which are hereby expressly incorporated by reference herein in their entirety.

FIELD OF THE DISCLOSURE

The present invention relates to the field of pool cleaners, and in particular to a pool cleaner having a releasable brush assembly, and to methods of using the same.

BACKGROUND OF THE DISCLOSURE

A pool cleaner may be equipped with a rotating brush. When the pool cleaner is in use, an actuating mechanism of the pool cleaner drives the pool cleaner, causing the pool cleaner to move across the floor and/or sidewalls of the pool. At the same time, the actuating mechanism drives rotation of the brush through a transmission gear set, so that the wheel brush cleans debris from the floor and/or sidewalls of the pool. The rotating brush may become worn as it rubs against the pool and may require frequent replacement. However, current replacement options are cumbersome and time consuming.

SUMMARY

The present disclosure provides a pool cleaner equipped with a rotating brush assembly. The brush assembly is removably coupled to the pool cleaner using clamps that are accessible, supported by the pool cleaner, and operable by hand. The clamps may be manipulated between a ready configuration, a loaded configuration to receive a brush assembly, and a locked configuration to secure the brush assembly.

According to an exemplary embodiment of the present disclosure, a pool cleaner configured to clean a pool is disclosed, the pool cleaner including a housing, a driving assembly, a transmission assembly operably coupled to the driving assembly, the transmission assembly including a brush gear, at least one traction assembly operably coupled to the transmission assembly and configured to convey the housing across the pool, a mounting rod coupled to the brush gear, a clamp supported on the mounting rod, and a brush assembly removably coupled to the housing. The pool cleaner has a ready configuration in which the mounting rod is exposed through the clamp and configured to receive the brush assembly, a loaded configuration in which the brush assembly is positioned against the mounting rod, and a locked configuration in which the clamp holds the brush assembly against the mounting rod such that rotation of the brush gear is transferred to the brush assembly via the mounting rod.

In certain embodiments, an outer end of the mounting rod is keyed to the brush gear or integrally formed with the brush gear.

In certain embodiments, the mounting rod includes a flat connection surface with a positioning slot and the brush assembly includes a flat connection surface with a positioning rod. In the loaded and locked configurations, the flat connection surface of the mounting rod contacts the flat connection surface of the brush assembly, and the positioning slot of the mounting rod receives the positioning rod of the brush assembly.

In certain embodiments, the mounting rod includes a rounded connection surface and the brush assembly includes a rounded connection surface. In the loaded and locked configurations, the rounded connection surfaces cooperate to mate with the clamp.

In certain embodiments, the clamp includes a hollow body with a notch sized to receive a connection post at an end of the brush assembly. In the ready configuration, the mounting rod is exposed through the notch in the clamp. In the loaded configuration, the connection post of the brush assembly has passed through the notch and into contact with the mounting rod.

In certain embodiments, the clamp inhibits removal of the connection post through the notch in the locked configuration.

In certain embodiments, the clamp is rotated about the mounting rod from the loaded configuration to the locked configuration.

In certain embodiments, the clamp includes a hollow body with a groove and the brush assembly includes a rib. In the loaded configuration, the rib is disengaged from the clamp. In the locked configuration, the rib is captured in the groove of the clamp. The groove of the clamp may include at least one positioning recess, and the rib of the brush assembly may include at least one positioning bump sized for receipt in the at least one positioning recess in the locked configuration.

In certain embodiments, the clamp includes a plate with a through-hole, the mounting rod extending through the through-hole to the brush gear. The housing may include a foot that supports the mounting rod, wherein the plate of the clamp is located inward of the foot.

In certain embodiments, the clamp is a first clamp configured to receive a first end of the brush assembly, the pool cleaner further comprising a second clamp configured to receive a second end of the brush assembly.

According to another exemplary embodiment of the present disclosure, a pool cleaner configured to clean a pool is disclosed, the pool cleaner including a housing having a foot, a driving assembly, a transmission assembly operably coupled to the driving assembly, the transmission assembly including a brush gear, at least one traction assembly operably coupled to the transmission assembly and configured to convey the housing, across the pool, a brush assembly, a mounting rod supported by the foot of the housing, the mounting rod extending outward to engage the brush gear and inward to support the brush assembly, a clamp rotatable between a first configuration in which the brush assembly is movable relative to the mounting rod and a second configuration in which the brush assembly is secured to the mounting rod such that rotation of the brush gear is transferred to the brush assembly via the mounting rod.

In certain embodiments, the clamp is supported on the mounting rod at a location inward of the foot.

In certain embodiments, the brush assembly and the clamp rotate about the same axis.

In certain embodiments, the clamp is captured between the foot on one side and a raised stop ring of the mounting rod on the other side.

According to yet another exemplary embodiment of the present disclosure, a method of using a pool cleaner is disclosed including the steps of inserting a brush assembly into a clamp and into contact with a mounting rod, rotating the clamp to secure the brush assembly against the mounting rod, and operating a driving assembly to rotate at least one traction mechanism, the mounting rod, and the brush assembly via the mounting rod.

In certain embodiments, the inserting step comprises inserting a positioning rod of the brush assembly into a positioning slot of the mounting rod.

In certain embodiments, the rotating step comprises capturing a rib of the brush assembly in a groove of the clamp.

In certain embodiments, the method further includes rotating the clamp in an opposite direction, separating the brush assembly from the mounting rod, and replacing the brush assembly with a new brush assembly.

BRIEF DESCRIPTION OF THE DRAWINGS

The above-mentioned and other features and advantages of this disclosure, and the manner of attaining them, will become more apparent and be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
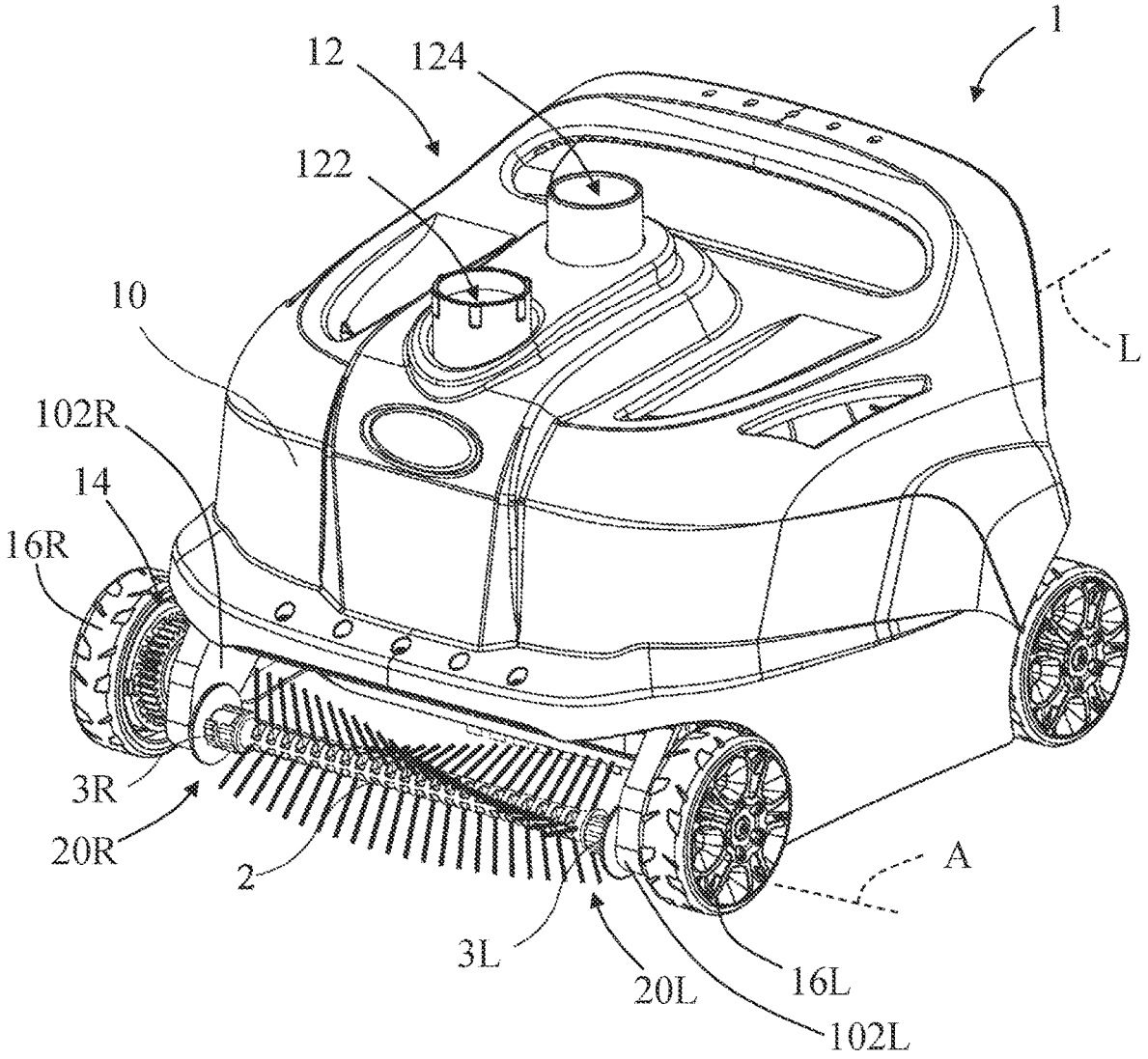
FIG. 1 is a perspective view of a pool cleaner including an exemplary brush assembly of the present disclosure.

FIG. 1 provides a pool cleaner 1 configured to clean a floor and/or sidewalls of a pool. The pool cleaner 1 includes a housing 10 having a longitudinal axis L and front feet 102R, L. The pool cleaner 10 also includes a hydraulic driving assembly 12 including a water inlet 122, a water outlet 124, and an impeller (not shown) disposed within the housing 10 and in fluid communication between the water inlet 122 and the water outlet 124. The pool cleaner 1 also includes a filtration assembly (not shown) disposed within the housing 10 to collect debris. The pool cleaner 1 further includes a transmission assembly 14 operably coupled to the driving assembly 12 and including a plurality of gears, including brush gears (shown elsewhere). The pool cleaner 1 further includes one or more traction assemblies, illustratively two right wheels 16R and two left wheels 16L, operably coupled to the transmission assembly 14.

The pool cleaner 1 also includes at least one rotating brush assembly 2 having opposing right and left ends 20R, 20L removably coupled to the housing 10 using right and left clamps 3R, 3L, respectively. Advantageously, the clamps 3R, 3L are readily accessible, are supported by the pool cleaner 1 (i.e., are not detachable), and are operable by hand without the use of additional tools. These clamps 3R, 3L are described in detail below. In FIG. 1, the brush assembly 2 extends laterally across a front end of the housing 10 between feet 102R, 102L, along an axis A that is perpendicular to the longitudinal axis 1, of the housing 10, but this position may vary. It is also within the scope of the present disclosure for the pool cleaner 1 to include more than one brush assembly 2, such as a second brush assembly (not shown) that extends laterally across a rear end of the housing 10.

In operation, water travels through the water inlet 122, across the impeller, and out of the water outlet 124, which rotates the impeller. The impeller's rotation is transferred to the wheels 16R, 16L via the transmission assembly 14, which causes the pool cleaner 1 to drive across the pool. The impeller's rotation is also transferred to the brush assembly 2 via the transmission assembly 14, which causes the brush assembly 2 to rotate about the axis A to clear debris from the pool.

Figure 2:
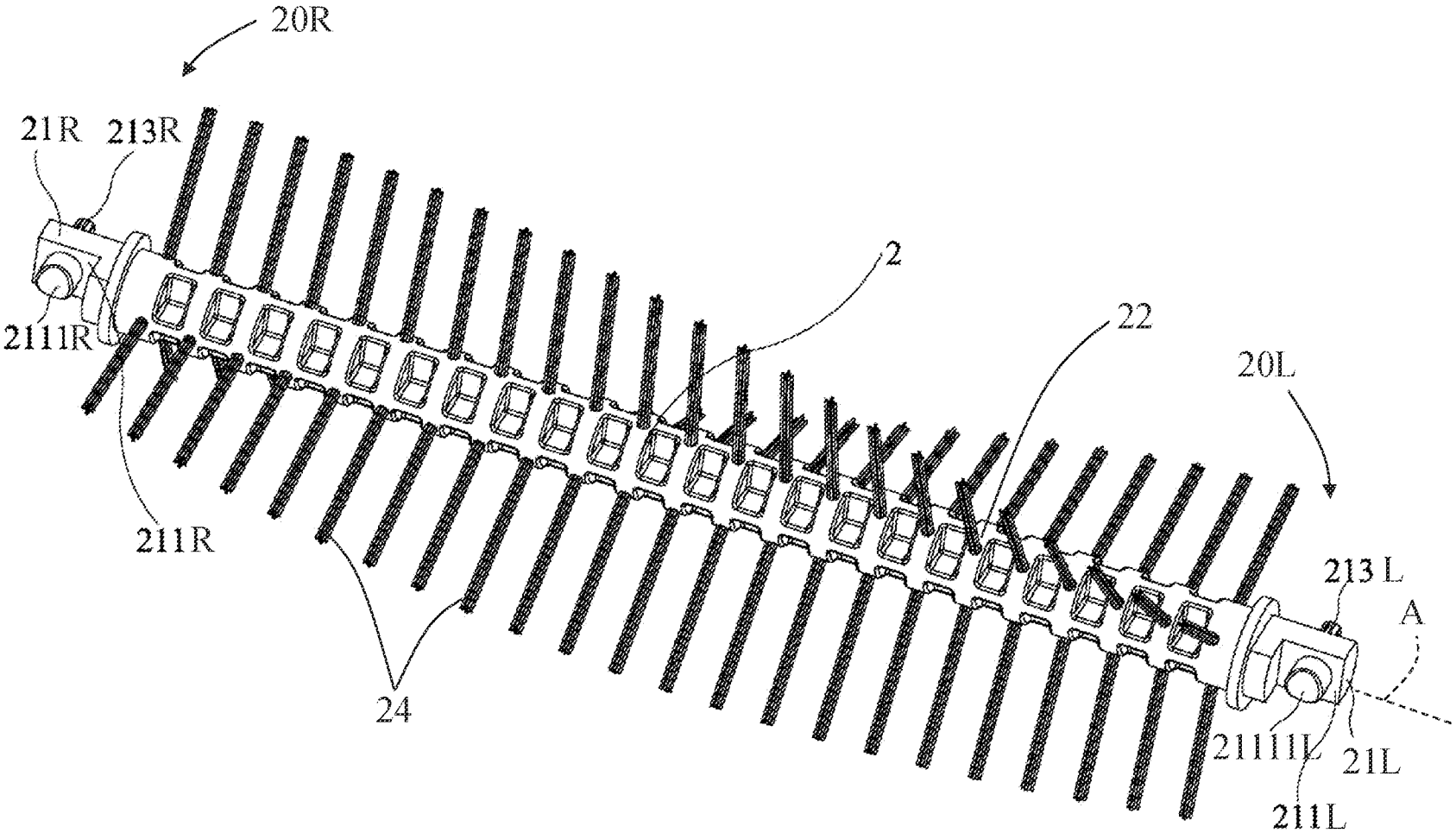
FIG. 2 is a first perspective view of the brush assembly showing a first side of the brush assembly.
Figure 3:
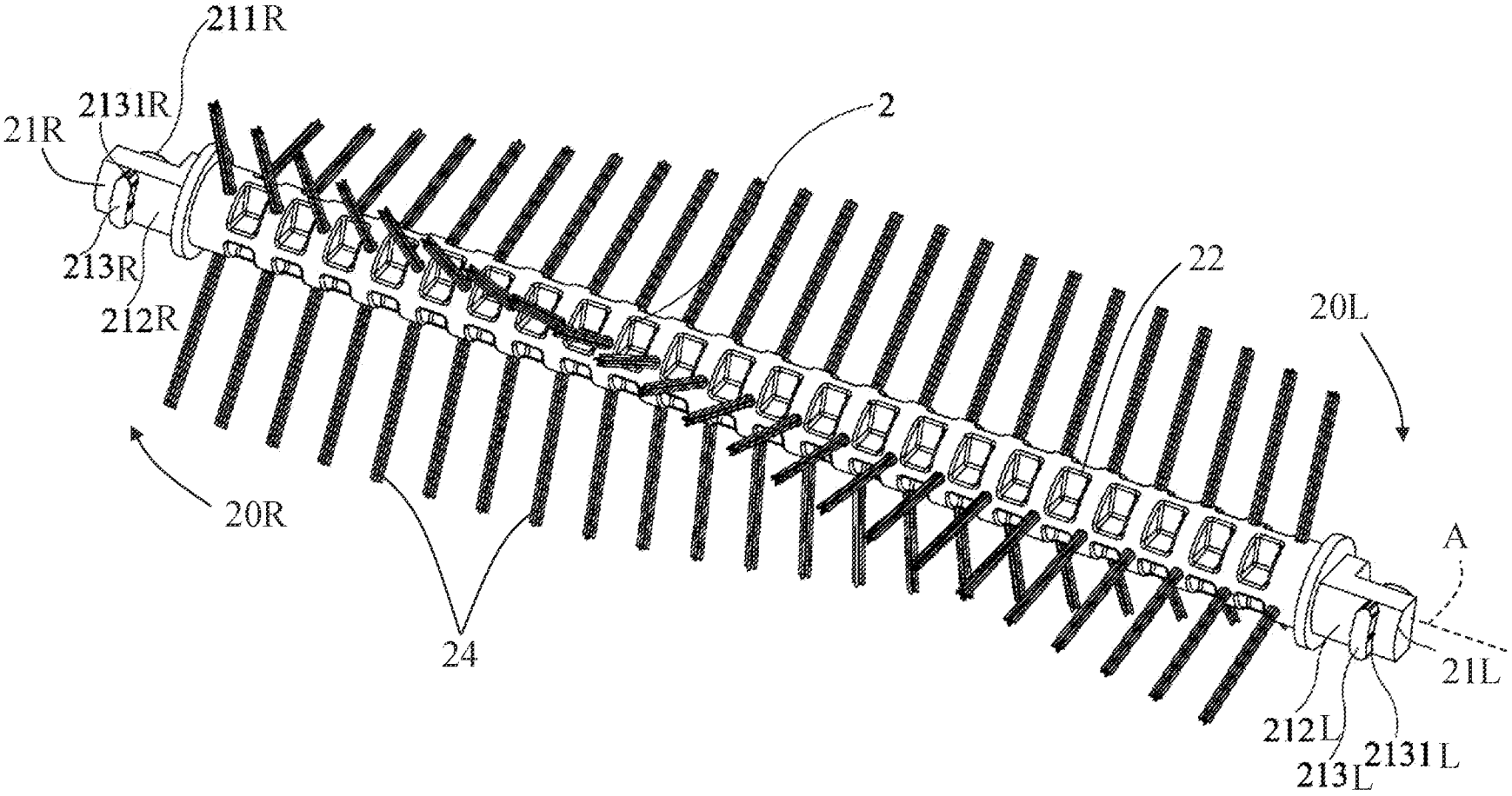
FIG. 3 is a second perspective view of the brush assembly showing a second side of the brush assembly.

The brush assembly 2 is shown in FIGS. 2 and 3. The brush assembly 2 includes a shaft 22 that extends along the rotation axis A and a plurality of bristles 24 extending radially outward from the shaft 22. At each end 20R, 20L, brush assembly 2 includes a connection arm 21R, 21L, which may be integrally formed with shaft 22 or otherwise attached to shaft 22 (e.g., welded, adhered, fastened). Each connection arm 21R, 21L has a flat connection surface 211R, 211L on one side (FIG. 2) and a rounded connection surface 212R, 212L on the opposing side (FIG. 3). A positioning pin 2111R, 2111L extends radially outward from each flat connection surface 211R, 211L (FIG. 2). A limiting rib 213R, 213L extends radially outward from each rounded connection surface 212R, 212L, with one or more positioning, bumps 2131R, 2131L centrally located on each limiting rib 213R, 213L.

Figure 4:
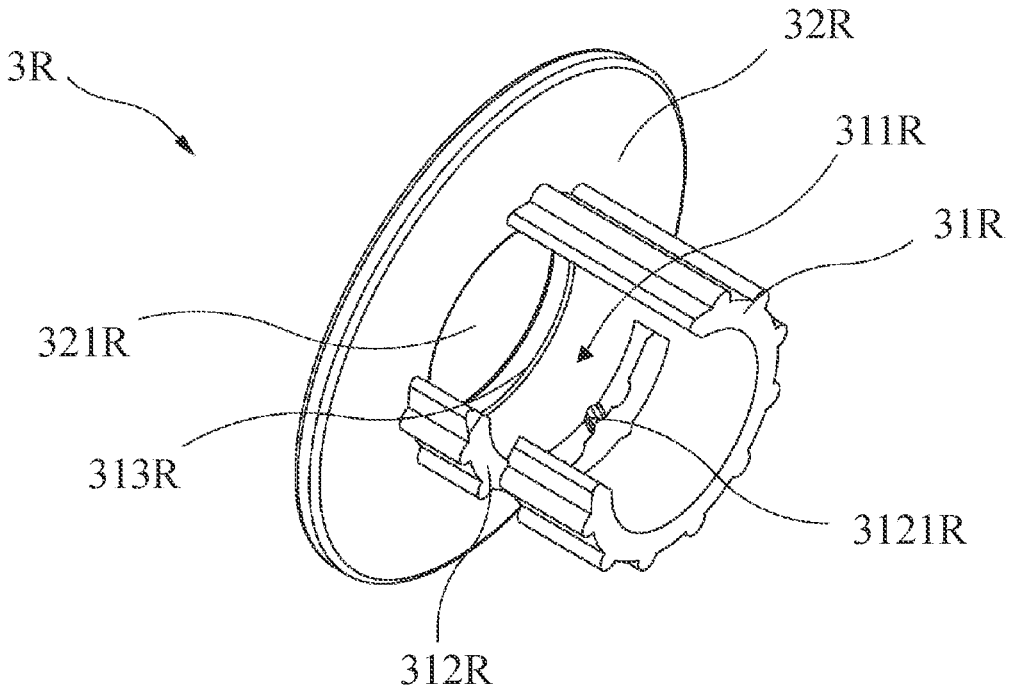
FIG. 4 is a perspective view of an exemplary clamp of the present disclosure.

The right clamp 3R is shown in FIG. 4. The following description is written in terms of the right clamp 3R, but it is understood that this description may also apply to the left clamp 3L, which may be a mirror image of the right clamp 3R. The right clamp 3R includes an inner hollow body 31R coupled to an outer fixing plate 32R. The hollow body 31R may be knurled or otherwise textured to facilitate gripping by a user. The hollow body 31R is interrupted by a notch 311R such that the hollow body 31R is arc-shaped (e.g., C-shaped) with a radian greater than 90° and less than 180°. A circumferential limiting groove 312R extends from the notch 311R and through a central portion of the hollow body 31R, with one or more positioning recesses 3121R centrally located in the limiting groove 312R. A limiting step 313R extends radially inward from the hollow body 31R adjacent to the fixing plate 32R. A through-hole 321R extends through the fixing plate 32R and communicates with the hollow interior of the body 31R.

Figure 5:
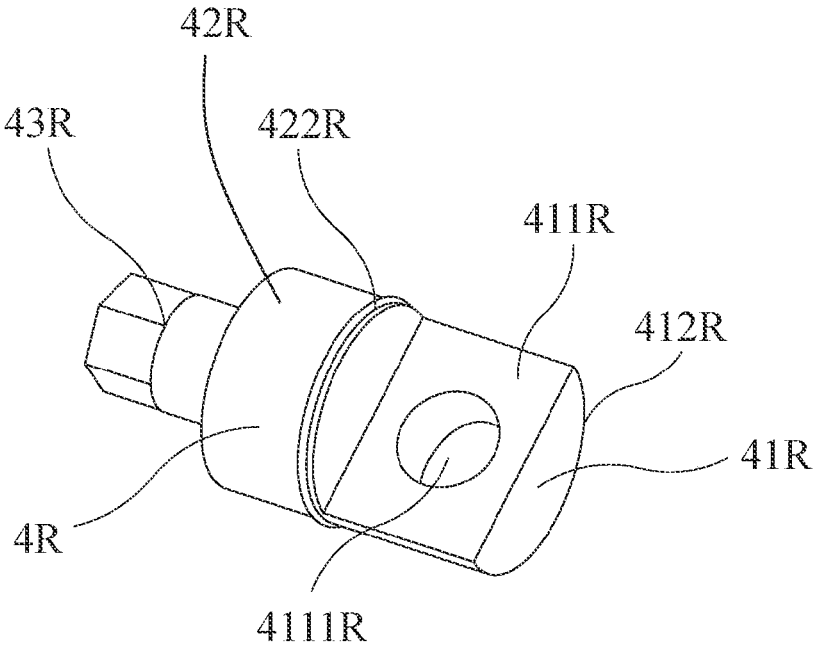
FIG. 5 is a perspective view of an exemplary mounting rod of the present disclosure.

A right mounting rod 4R (which may also be referred to herein as a torsion rod) is shown in FIG. 5. The following description is written in terms of the right mounting rod 4R, but it is understood that this description may also apply to the left mounting rod (not shown), which may be a mirror image of the right mounting rod 4R. The right mounting rod 4R includes an inner connection post 41R, an intermediate body 42R having a stop ring 422R that extends radially outward from the intermediate body 42R, and an outer driven end 43R having a hexagonal profile, although this profile may vary. The connection post 41R has a flat connection surface 411R on one side and a rounded connection surface 412R on the opposing side. The flat connection surface 411R or the connection post 41R includes a positioning slot 4111R.

Figure 6:
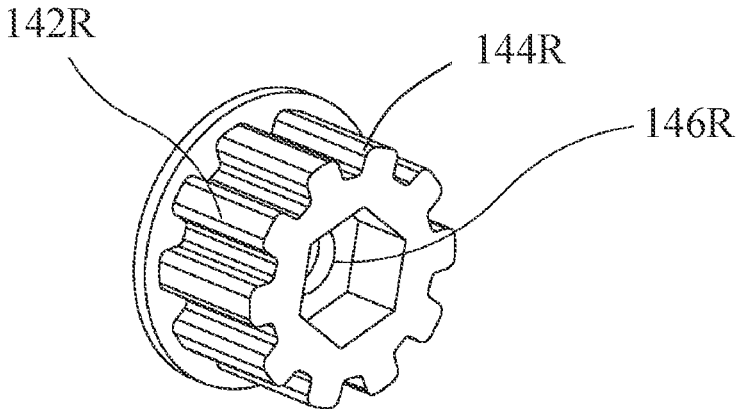
FIG. 6 is a perspective view of an exemplary brush gear of the present disclosure.

A right brush gear 142R is shown in FIG. 6. The following description is written in terms of the right brush gear 142R, but it is understood that this description may also apply to the left brush gear (not shown), which may be a mirror image of the right brush gear 142R. The right brush gear 142R includes outer gear teeth 144R configured to mesh with other gears of the transmission assembly 14 (FIG. 1). The right brush gear 142R also includes a driving end formed by an internal notch 146R having a hexagonal shape, although this shape may vary.

Figure 7:
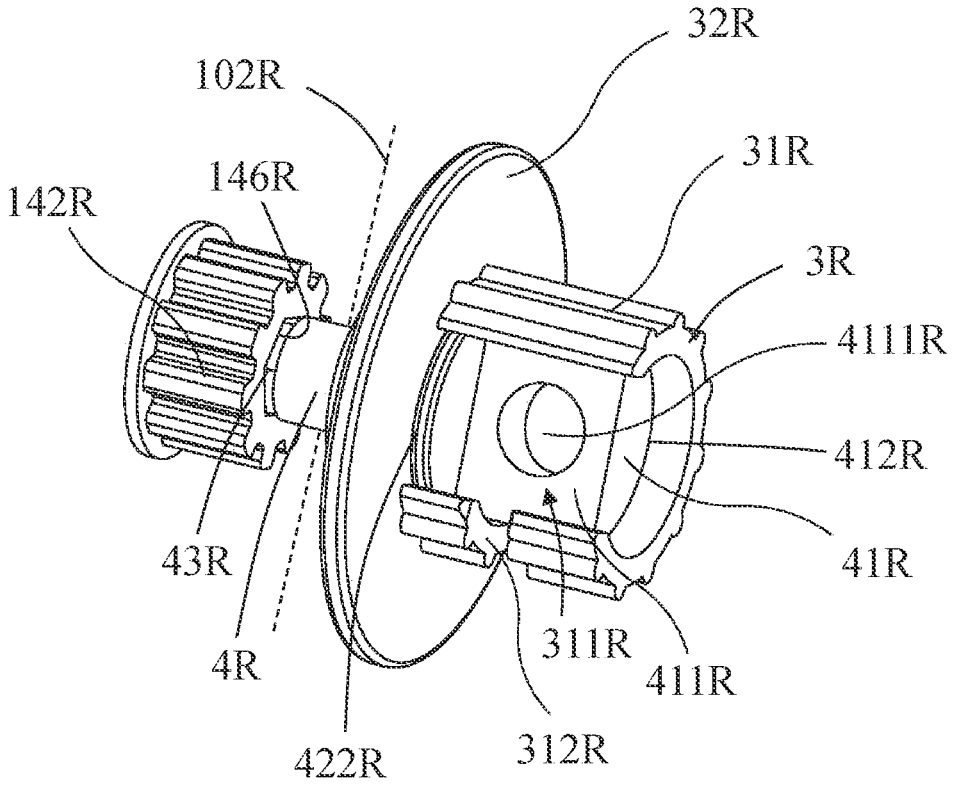
FIG. 7 is a perspective view of the clamp, the mounting rod, and the brush gear in a ready configuration.

The right brush gear 142R, the right mounting rod 4R, and the right clamp 3R are shown together in FIG. 7. The right mounting rod 4R is rotatably supported by the right foot 102R of the housing 10 (FIG. 1), with the right brush gear 142R located outward relative to the foot 102R (i.e., further from the longitudinal axis L of FIG. 1) and the right clamp 3R located inward relative to the foot 102R (i.e., closer to the longitudinal axis L of FIG. 1).

Outward from (or concealed within) the foot 102R, the right brush gear 142R is coupled to the right mounting rod 4R, such that rotation of the right brush gear 142R is transferred to the right mounting rod 4R. In FIG. 7, the hexagonal driving end 146R of the right brush gear 142R receives the hexagonal driven end 43R of the right mounting rod 4R in a keyed manner. As noted above, these hexagonal profiles may vary. It is also within the scope of the present disclosure for the right brush gear 142R and the right mounting rod 4R to be integrally formed together or otherwise attached together (e.g., welded, adhered, fastened).

Inward of the foot 102R, the right clamp 3R is supported on the right mounting rod 4R. In FIG. 7, the hollow body 31R of the right clamp 3R receives the connection post 41R of the right mounting rod 4R, and the fixing plate 32R of the right clamp 3R is supported on the intermediate body 42R (FIG. 5) of the right mounting rod 4R. In this position, the stop ring 422R of the right mounting rod 4R abuts the limiting step 313R of the right clamp 3R (FIG. 4) to retain the right clamp 3R on the right mounting rod 4R. Thus, the right clamp 3R is retained between the foot 102R on the outside and the stop ring 422R on the inside. The driven end 43R of the right mounting rod 4R extends outwardly through the through-hole 321R (FIG. 4) in the fixing plate 32R and through the right foot 102R to mate with the right brush gear 142R, as described above.

The insertion of a new brush assembly 2 will now be described with reference to FIGS. 7-12.

Figure 8:
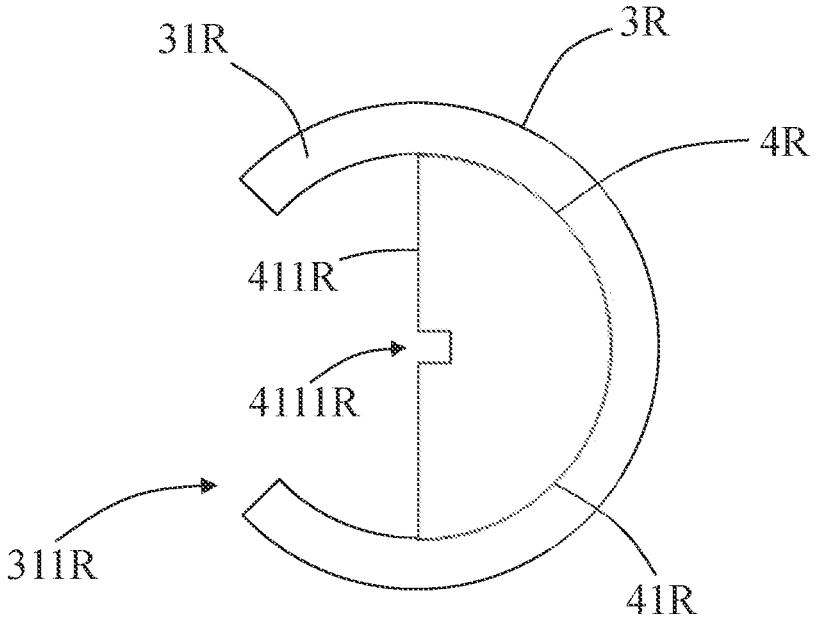
FIG. 8 is a schematic axial view of the ready configuration of FIG. 7.

The components are shown in a ready configuration in FIGS. 7 and 8. In this ready configuration, the hollow body 31R of the right clamp 3R and/or the connection post 41R of the right mounting rod 4R have been rotated such that the flat connection surface 411R and the positioning slot 4111R of the right mounting rod 4R are aligned with the notch 311R in the right clamp 3R. In other words, the positioning slot 4111R is visible and accessible through the notch 311R. Such rotation may be achieved by gripping and rotating the textured hollow body 31R.

Figure 9:
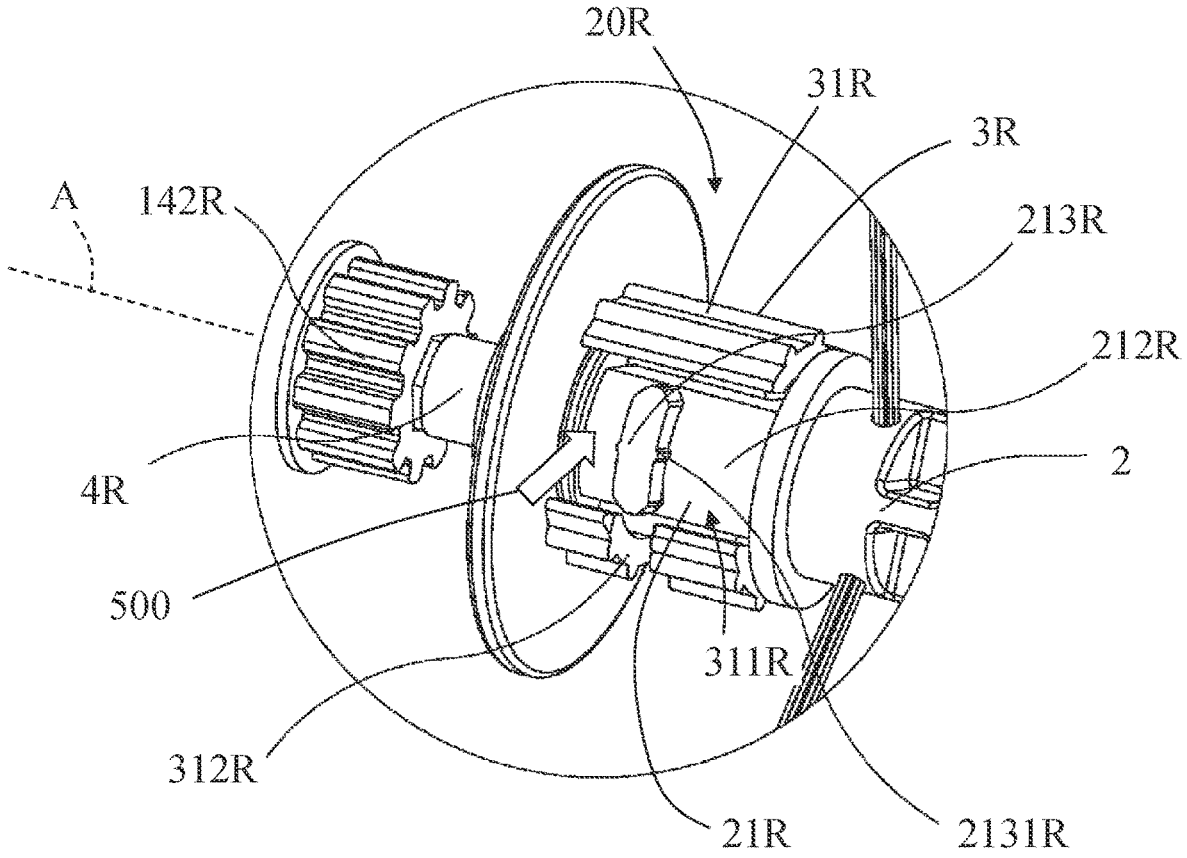
FIG. 9 is a perspective view of the clamp, the mounting rod, the brush gear, and the brush assembly in a loaded configuration.
Figure 10:
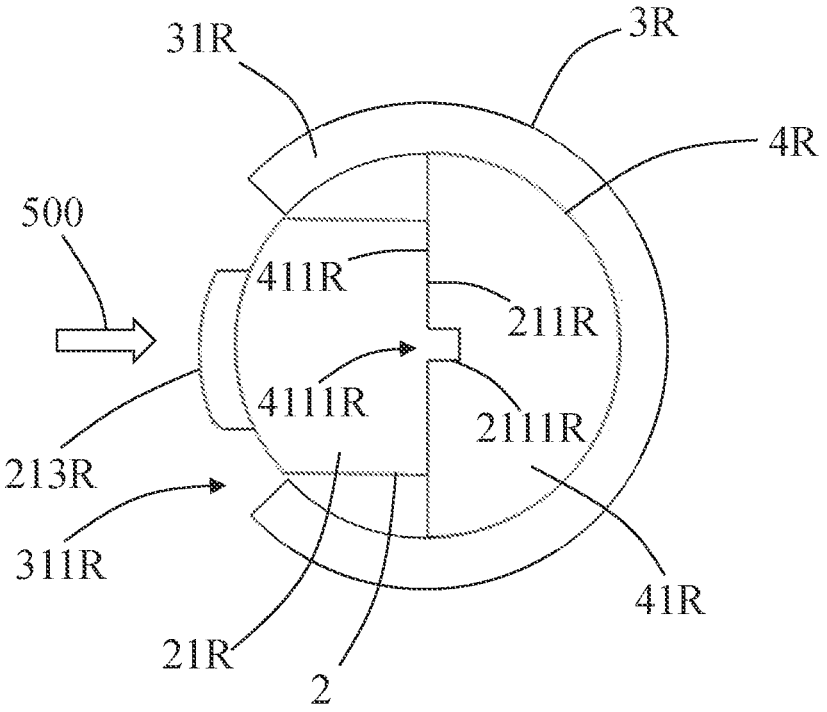
FIG. 10 is a schematic axial view of the loaded configuration of FIG. 9.

The components are shown in a loaded configuration in FIGS. 9 and 10, with the brush assembly 2 coupled to the right mounting rod 4R. In this loaded configuration, the connection arm 21R of the brush assembly 2 has been inserted radially through the notch 311R and into the hollow body 31R of the right clamp 3R in a radial direction 500. The radial extent of the notch 311R may be sufficiently large to receive the connection arm 21R. The flat connection surface 211R of the brush assembly 2 abuts the flat connection surface 411R of the right mounting rod 4R, with the positioning pin 2111R of the brush assembly 2 extending radially into the positioning slot 4111R of the right mounting rod 4R, thereby inhibiting axial movement of the brush assembly 2 relative to the right mounting rod 4R. It is within the scope of the present disclosure to reverse the placement of the positioning pin 2111R and the positioning slot 4111R, such that the positioning pin 2111R is instead located on the right mounting rod 4R and the positioning slot 4111R is instead located on the brush assembly 2.

Figure 11:
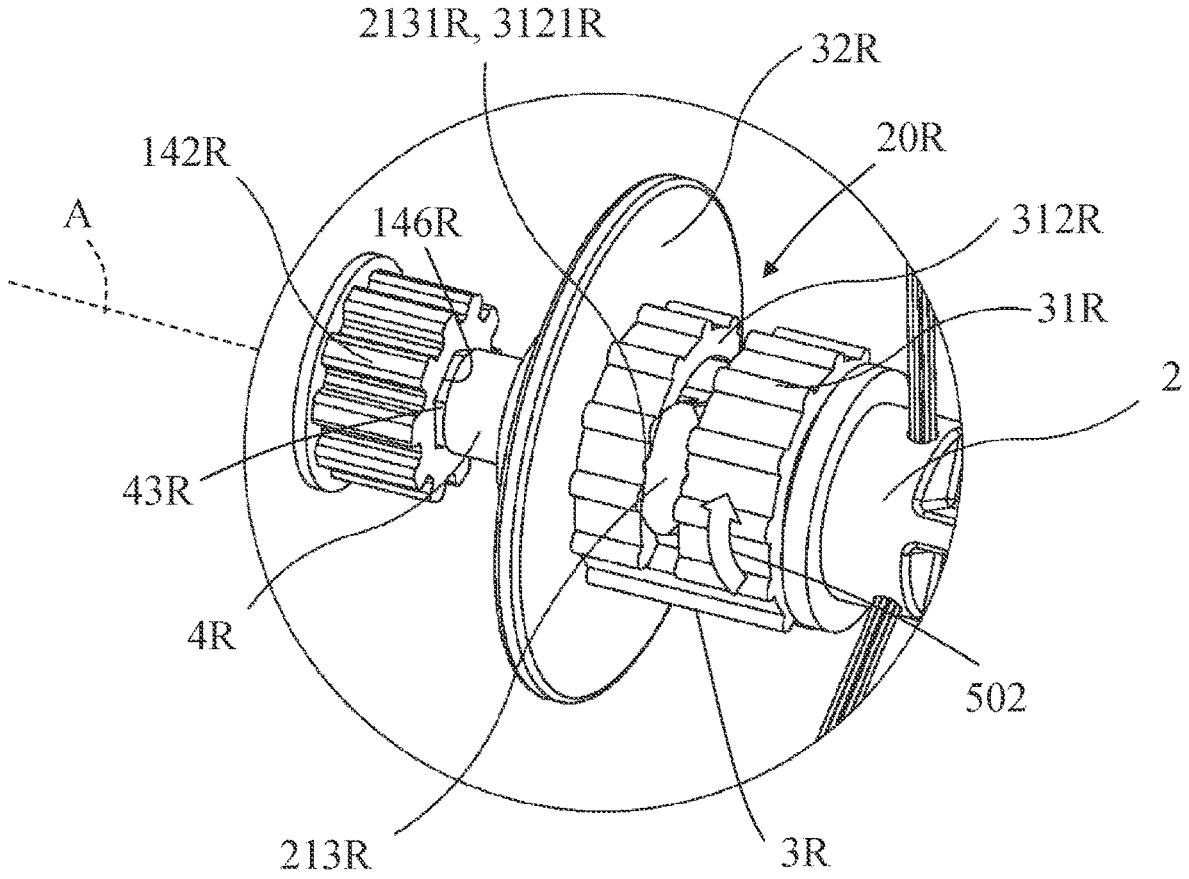
FIG. 11 is a perspective view of the clamp, the mounting rod, the brush gear, and the brush assembly in a locked configuration.
Figure 12:
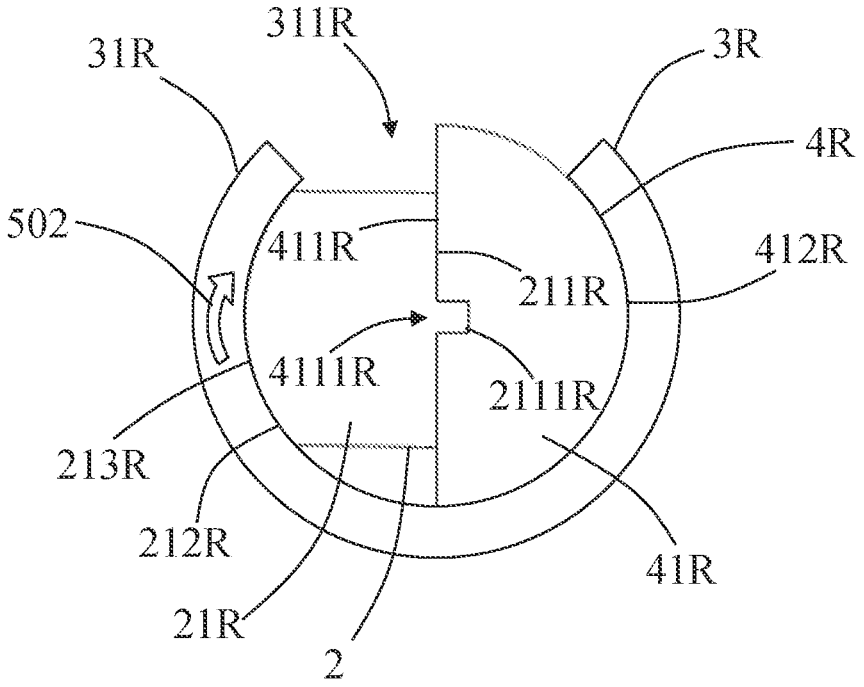
FIG. 12 is a schematic axial view of the locked configuration of FIG. 11.

The components are shown in a locked configuration in FIGS. 11 and 12, with the brush assembly 2 further coupled to the right clamp 3R. In this locked configuration, the hollow body 31R of the right clamp 3R has been rotated in a direction 502 (e.g., upward) to capture the limiting rib 213R of the brush assembly 2 within the limiting groove 312R of the right clamp 3R, thereby inhibiting both radial and axial movement of the brush assembly 2 relative to the right clamp 3R. Such rotation may be achieved by gripping and rotating the textured hollow body 31R. This locked configuration may be retained by forcing the positioning bumps 2131R of the limiting rib 213R into corresponding positioning recesses 3121R of the limiting groove 312R, which act as detent mechanisms to inhibit further rotation of the right clamp 3R.

As shown in FIG. 12, the locked configuration captures the connection arm 21R of the brush assembly 2 and the connection post 41R of the right mounting rod 4R within the hollow body 31R of the right clamp 3R. With the flat connection surface 211R of the connection arm 21R abutting the flat connection surface 411R of the connection post 41R, the rounded connection surface 212R of the connection arm 21R and the rounded connection surface 412R of the connection post 41R (FIG. 7) cooperate to define a generally cylindrical outer profile that fits within the generally cylindrical hollow body 31R. The outer diameter of the connection arm 21R and the connection post 41R. (measured between the rounded connection surfaces 212R, 412R) may be equal to or slightly larger than the inner diameter of the cylindrical hollow body 31R to facilitate close contact between the components. In this way, the hollow body 31R clamps the connection arm 21R and the connection post 41R together and firmly retains the positioning pin 2111R in the positioning slot 4111R. It is understood that the connection arm 21R, the hollow body 31R, and the connection post 41R may vary in shape while ensuring this clamped connection.

With the brush assembly 2 in the locked configuration, the pool cleaner 1 of FIG. 1 may be operated to clean the pool. As noted above, this operation involves rotating the impeller (not shown) and various gears of the transmission assembly 14, including the right brush gear 142R that interacts with the right end 20R of the brush assembly 2 in FIG. 11. The rotation of the right brush gear 142R is transferred to the right mounting rod 4R via the keyed connection therebetween, as described above. Then, the rotation of the right mounting rod 4R is transferred to the connection arm 21R of the brush assembly 2 via the clamped connection therebetween, as described above. The left end 201 of the brush assembly 2 (FIG. 1) may be rotated in a similar manner.

The brush assembly 2 may become worn over time. The worn brush assembly 2 may be removed by reversing the above-described insertion process. First, the worn brush assembly 2 may be unlocked by moving the components from the locked configuration of FIGS. 11 and 12 to the loaded configuration of FIGS. 9 and 10. This unlocking step may involve rotating the hollow body 31R of the right clamp 3R opposite the direction 502 (i.e., downward) to free the limiting rib 213R of the connection arm 21R from the limiting groove 312R of the right clamp 3R. Then, the brush assembly 2 may be removed by moving the components from the loaded configuration of FIGS. 9 and 10 to the ready configuration of FIGS. 7 and 8. This removing step may involve pulling the connection arm 21R through the exposed notch 311R of the hollow body 31R opposite the direction 500, which also frees the positioning pin 2111R of the connection arm 21R from the positioning slot 4111R of the connection post 41R. With the components in the ready configuration, the insertion process may be repeated with a fresh, replacement brush assembly 2.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pool cleaner configured to clean a pool, the pool cleaner comprising:
- a housing;
- a driving assembly;
- a transmission assembly operably coupled to the driving assembly, the transmission assembly including a brush gear;
- at least one traction assembly operably coupled to the transmission assembly and configured to convey the housing across the pool;
- a mounting rod coupled to the brush gear;
- a clamp supported on the mounting rod; and
- a brush assembly removably coupled to the housing;
- wherein the pool cleaner has:
  - a ready configuration in which the mounting rod is exposed through the clamp and configured to receive the brush assembly;
  - a loaded configuration in which the brush assembly is positioned against the mounting rod; and
  - a locked configuration in which the clamp holds the brush assembly against the mounting rod such that rotation of the brush gear is transferred to the brush assembly via the mounting rod.

2. The pool cleaner of claim 1, wherein an outer end of the mounting rod is keyed to the brush gear or integrally formed with the brush gear.

3. The pool cleaner of claim 1, wherein:
- the mounting rod includes a flat connection surface with a positioning slot;
- the brush assembly includes a flat connection surface with a positioning rod; and
- in the loaded and locked configurations, the flat connection surface of the mounting rod contacts the flat connection surface of the brush assembly, and the positioning slot of the mounting rod receives the positioning rod of the brush assembly.

4. The pool cleaner of claim 1, wherein:
- the mounting rod includes a rounded connection surface;
- the brush assembly includes a rounded connection surface; and
- in the loaded and locked configurations, the rounded connection surfaces cooperate to mate with the clamp.

5. The pool cleaner of claim 1, wherein:
- the clamp includes a hollow body with a notch sized to receive a connection post at an end of the brush assembly;
- in the ready configuration, the mounting rod is exposed through the notch in the clamp; and
- in the loaded configuration, the connection post of the brush assembly has passed through the notch and into contact with the mounting rod.

6. The pool cleaner of claim 5, wherein, in the locked configuration, the clamp inhibits removal of the connection post through the notch.

7. The pool cleaner of claim 1, wherein the clamp is rotated about the mounting rod from the loaded configuration to the locked configuration.

8. The pool cleaner of claim 1, wherein:
- the clamp includes a hollow body with a groove;
- the brush assembly includes a rib;
- in the loaded configuration, the rib is disengaged from the clamp; and
- in the locked configuration, the rib is captured in the groove of the clamp.

9. The pool cleaner of claim 8, wherein:
- the groove of the clamp includes at least one positioning recess; and
- the rib of the brush assembly includes at least one positioning bump sized for receipt in the at least one positioning recess in the locked configuration.

10. The pool cleaner of claim 1, wherein the clamp includes a plate with a through-hole, the mounting rod extending through the through-hole to the brush gear.

11. The pool cleaner of claim 10, wherein the housing includes a foot that supports the mounting rod, wherein the plate of the clamp is located inward of the foot.

12. The pool cleaner of claim 1, wherein the clamp is a first clamp configured to receive a first end of the brush assembly, the pool cleaner further comprising a second clamp configured to receive a second end of the brush assembly.

13. A pool cleaner configured to clean a pool, the pool cleaner comprising:
- a housing having a foot;
- a driving assembly;
- a transmission assembly operably coupled to the driving assembly, the transmission assembly including a brush gear;
- at least one traction assembly operably coupled to the transmission assembly and configured to convey the housing across the pool;
- a brush assembly;
- a mounting rod supported by the foot of the housing, the mounting rod extending outward to engage the brush gear and inward to support the brush assembly;
- a clamp rotatable between a first configuration in which the brush assembly is movable relative to the mounting rod and a second configuration in which the brush assembly is secured to the mounting rod such that rotation of the brush gear is transferred to the brush assembly via the mounting rod.

14. The pool cleaner of claim 13, wherein the clamp is supported on the mounting rod at a location inward of the foot.

15. The pool cleaner of claim 13, wherein the brush assembly and the clamp rotate about the same axis.

16. The pool cleaner of claim 13, wherein the clamp is captured between the foot on one side and a raised stop ring of the mounting rod on the other side.

* * * * *